United States Patent [19]

Brooks et al.

[11] 4,435,296

[45] Mar. 6, 1984

[54] LUBRICATING GREASE

[75] Inventors: Christopher P. Brooks, Addlestone; Stanley C. Dodson, Leatherhead; Robert H. Newman, Weybridge, all of England

[73] Assignee: The British Petroleum Company Limited, London, England

[21] Appl. No.: 266,607

[22] Filed: May 22, 1981

[51] Int. Cl.[3] ..... C10M 7/30; C10M 1/10

[52] U.S. Cl. ..... 252/28; 252/25; 252/496

[58] Field of Search ..... 252/25, 28, 49.6

[56] References Cited

U.S. PATENT DOCUMENTS

| | | | |
|---|---|---|---|
| 3,271,309 | 9/1966 | Caruso | 252/25 |
| 3,488,721 | 1/1970 | Frye | 252/25 |
| 3,676,342 | 7/1972 | Gathman et al. | 252/25 |
| 3,729,415 | 4/1973 | Davis et al. | 252/25 |
| 3,835,050 | 9/1974 | Green | 252/25 |
| 3,935,114 | 1/1976 | Donaho, Jr. | 252/25 |
| 4,105,578 | 8/1978 | Finlayson et al. | 252/28 |
| 4,136,040 | 1/1979 | De Vries et al. | 252/25 |
| 4,149,981 | 4/1979 | Kafarov et al. | 252/25 |
| 4,155,858 | 5/1979 | Adams | 252/25 |
| 4,203,854 | 5/1980 | Silverstein | 252/25 |

FOREIGN PATENT DOCUMENTS

| | | | |
|---|---|---|---|
| 789421 | 1/1958 | United Kingdom | 252/25 |
| 915403 | 1/1963 | United Kingdom | 252/25 |

*Primary Examiner*—Natalie Trousof
*Assistant Examiner*—Raymond K. Covington
*Attorney, Agent, or Firm*—Morgan, Finnegan, Pine, Foley & Lee

[57] ABSTRACT

A light colored, open gear lubricating grease is formed from:

- a lubricating base oil
- a clay thickener
- a combination of a polymer, preferably atactic polypropylene, and a particulate mineral, preferably zinc oxide, as tactifier and filler, and
- and alkali metal borate as EP additive.

The ratio of polymer to mineral, may be from 1.5:1 to 1:1.5. An aromatic disulphide, preferably dibenzyl disulphide, may also be present as an EP additive and, if so, the wt. ratio of borate to disulphide may be from 5:1 to 7:1.

4 Claims, No Drawings

LUBRICATING GREASE

This invention relates to a lubricating grease suitable for open-gears.

Open gear lubricants are a special type of lubricant and have been marketed commerically for many years. As the name implies, the gears to be lubricated are open to the atmosphere and may thus be required to operate over a wide temperature range and in the presence of moisture. The lubricant is normally placed on the gear teeth and it has to have the quality of spreading uniformly over the teeth without dropping off. In one form of existing lubricant, bitumen is used as a basic component and in another form a lubricating base oil is thickened with carbon black and atactic polypropylene. These existing lubricants are, however, dark in colour and therefore dirty to use and do not have extreme pressure (EP) properties.

The present invention provides a clean, light cloured grease with EP properties.

According to the present invention a lubricating grease, suitable for use as an open gear lubricant, comprises a lubricating base oil, a clay thickener, a combination of a polymer and a particulate mineral as tackifier and filler, and an alkali metal borate as extreme pressure additive.

The lubricating base oil may be a mineral or synthetic base oil. For simplicity and cheapness it is preferably a lubricating base oil derived from petroleum. Thus, the base oil may be a refined oil obtained from petroelum having a viscosity of from 10 to 900 centistokes at 40° C.

The clay thickener may be of the type well known in the greasemaking art, i.e. a colloidal clay whose particles are coated with an oleophilic substance. An example of a clay thickener is a material consisting of platelets of montmorillonite coated with a quarternary ammonium salt. Such materials are sold under the Trade Marks "Baragel" and "Bentone" . The clay thickener may be present in an amount of from 2–15% wt. by weight of the total composition.

The grease may also contain, in conventional manner, a dispersant for the clay type thickener, e.g. from 0.1 to 3% wt. of propylene carbonate.

One of the problems associated with clay-thickened greases is that of finding additives which are compatible with the clay and its polar coating. However, for open gear lubricants, a clay thickened grease without additives is of little value.

In one aspect of the present invention, therefore, it has been found that the combination of a polymer and a particulate mineral is an additive combination which is compatible with the clay and which imparts to the grease good spreading properties without giving rise to excessive drop off from the gears. It has been found that the ratio of polymer to particulate mineral is important in this respect and that the reuired optimum balance of properties is obtained if the polymer: particulate mineral ratio is from 1.5:1 to 1:1.5, and preferably 1:1. The total quantity of each material may be from 2 to 20% wt. by weight of total composition, preferably from 3 to 12% wt.

The polymer is preferably an olefin polymer having elastic properties. The polymer may be a polyisobutylene (e.g. a material sold under the Registered Trade Name "Vistanex" ) with an average molecular weight of 40000 (viscosity average molecular weight (Flory)), or more preferably an atactic polypropylene, molecular weight approximately 30000 and a melt viscosity of 5000 to 10000 cPs at 170° C. and 2.7 $sec^{-1}$.

The particulate mineral is preferably light in colour. The preferred mineral is zinc oxide but other suitable minerals may be talc and titanium dioxide. The term "mineral" is to be understood as including both naturally occuring and synthetic materials.

Another important aspect of the invention is the choice of extreme pressure additive which, again, should be compatible with the clay thickener and should, preferably, provide extreme pressure qualities beyond those of existing open gear lubricants.

It has been found that an alkali metal borate alone gives good extreme pressure qualities. Alternatively the alkali metal borate may be used in combination with an aromatic disulphide, particularly dibenzyl disulphide. Again it has been found that the weight ratio of borate and disulphide is relevant to obtaining an optimum EP performance and the preferred weight ratio of borate to disulphide is from 5:1 to 7:1 and preferably 6:1. The total quanties of material may be from 2 to 12% wt. of borate, and 0.2 to 2% weight of aromatic disulphide, if this is present, by weight of total composition.

The alkali metal borate is preferably borax and it has been found that the borate confers anti-rust properties as well as EP properties. Despite its solubility in water, it has also been found that the borate is not leached out to any substantial extent by moisture and that the finished grease gives less than 1% wt. washout in the water washout test at 79° C. (ASTM D1264 or IP Method 215).

The borate may be incorporated into the grease using the technique known for incorporating alkali metal nitrites into clay thickened greases. Thus a solution of borate in water may be formed into an emulsion with a portion of the lubricating base oil and a portion of the clay thickener. The water may then be evaporated off leaving a dispersion of borate particles in the base oil which may then be blended with the remaining base oil and the other components of the grease. The size of the borate particles is believed to depend on the relative proportions of borate and oil. With a dispersion of about 50% borate in oil the particles may have a size of about 1 to 5 microns diameter, but sub-micron particles may be obtained by lowering the concentration of borate in the borate/oil dispersion.

The invention is illustrated by the following examples.

EXAMPLE 1

A lubricating grease was prepared having the following composition:

| | % wt |
|---|---|
| Clay thickener | 6.5 |
| Propylene carbonate | 0.9 |
| Atactic polypropylene | 5.0 |
| Zinc oxide | 5.0 |
| Borax | 5.0 |
| Dibenzyl disulphide | 0.8 |
| Lubricating base oil | 76.8 |

The clay thickener was the material sold by Berk Chemicals Ltd. under the Registered Trade Mark "Baragel" . The atactic polypropylene has a melt viscosity of 5700 cPs at 170° C., 2.7 $sec^{-1}$. It was sold by Chemie Linz AG as grade APP8. The zinc oxide has an average particle size of 0.2 μm and was sold by Morris Ashby Ltd. as "Zincoli" Red Seal grade. The borax was a laboratory grade of sodium tetraborate, $Na_2B_4O_7$ $10H_2O$, sold by BDH Chemicals Ltd. The lubricating base oil was a refined mineral lubricating oil having a viscosity of 30 centistokes at 40° C. and a viscosity index of 100.

The grease was prepared in three stages as follows. Firstly, a concentrate of the thickener and filler was prepared by dispersing the zinc oxide, Baragel and propylene carbonate in 60% of the base oil, at ambient temperature.

Secondly, the borax was dispersed in 20% of the base oil in a second mixing vessel. The borax was dissolved in water at 90° C. and added to the base oil at 90° C. A small quantity of Baragel and propylene carbonate were added to stabilise the water in oil enulsion. The temperature of the emulsion was then increased to 140° C. whilst mixing vigorously to boil off the water. The resultant dispersion of borax in oil was then cooled to 100° C. and added to the grease concentrate.

Finally the polypropylene was dissolved in the remaining base oil at 160° C. When the polypropylene has dissolved the temperature of the blend was reduced to 120° C. and the dibenzyl disulphide added and dissolved. The total blend was then added to the grease concentrate.

The resultant grease was then homogenised on a Manton Gaulin Homogeniser at 2000 psi to provide a smooth structure.

The grease was submitted to the following tests to evaluate its suitability as an open gear lubricant:

Open Gear Rig

The rig consists of a gear driven by and lightly loaded against a pinion. The gear axes are vertical. Running conditions are as follows:

Gear: Cast Iron, 3DP 40 tooth. 3.5 inches wide
Pinion: Steel 16 teeth
Pinion Speed: 40 rpm
Load: 12.5 lbf ft torque load on gear shaft.

A total of 110 g of grease is applied to the gear. Grease is applied to the driven face of each gear tooth. The rig is then run for two hours. At the end of the test only the minimum amount of grease should have dropped off the ring and the driven surfaces of the pinion and gear should by completely covered with grease.

| | |
|---|---|
| Open Gear Rig 2hr run drop off: | 8.0% wt |
| coverage: | Complete coverage of teeth |
| Cone Penetration: (IP Method 50/69) | Unworked = 235<br>Worked = 275 |
| Four Ball EP Performance (IP Method 239): | Mean Hertz Load = 67.9 kg<br>Initial Seizure Load = 158 kg<br>Weld Load = 355 kg |
| Water Washout (IP Method 215) 79° C.: = | below 1.0% wt |
| Dynamic Anti Rust Test (IP Method 220) = | rating 2,2. |

EXAMPLE 2

A series of greases was prepared according to Example 1 the only variant being the ratios and amounts of atactic polypropylene and zinc oxide.

Each grease was tested for its spreadability over the teeth of the open gear test ring described in Example 1 and for the amount of grease which dropped off the gears during the tests.

The results are shown in Table 1 below.

TABLE 1

| | | | | | | |
|---|---|---|---|---|---|---|
| % wt Zinc Oxide | 20 | 15 | 10 | 5 | 10 | 15 |
| % wt Polypropylene | 5 | 5 | 5 | 5 | 10 | 15 |
| % Drop Off | 15 | 10 | 9 | 3 | 11 | 27 |
| Coverage | insufficient coverage of gear teeth | | | total coverage of gear teeth | | some bare spots on gear teeth |

Taking the results of Table 1 in succession from left to right it will be seen that, as the ratio of zinc oxide to polypropylene decreases from 4:1 to 1:1 there is a steady improvement in % drop off and in coverage, the best result being at a 1:1 ratio and 5% wt. of each. If the ratio is kept at 1:1 and the amount of each is increased, however, drop off increases and coverage becomes less certain.

EXAMPLE 3

A series of greases was prepared according to Example 1 the only variant being the ratios and amounts of borax and dibenzyl disulphide.

Each grease was tested for EP properties using the 4 Ball test.

The results are shown in Table 2 below.

| | | | | | | |
|---|---|---|---|---|---|---|
| % wt Borax | 7.5 | — | 5.0 | 5.0 | 2.5 | 5.0 |
| % wt DBDS | — | 2.2 | 0.5 | 1.0 | 2.0 | 0.8 |
| 4 Ball EP (IP 239/73) | | | | | | |
| Mean Hertz Load kg | 53.9 | 56.8 | 50.2 | 63.0 | 63.6 | 67.9 |
| Initial Seizure Load kg | 141 | 79 | 126 | 141 | 89 | 158 |
| Welding Load kg | 398 | 335 | 282 | 355 | 398 | 355 |

Table 2 shows that good EP properties were obtained using borax alone. When mixtures of borax and DBDS were used, the optimum borax: DBDS ratio was about 6:1.

EXAMPLE 4

Two lubricating grease were prepared as in Example 1 except that no dibenzyl disulphide was added.

For grease A the omission of the dibenzyl disulphide was the only difference; for grease B there was the additional difference that the filler was added after the polypropylene.

The greases were also tested as in Example 1. the compositions of the greases and the test results are shown in Table 3 below.

TABLE 3

| Grease | A | B |
|---|---|---|
| Clay thickener % wt. | 7.2 | 10.5 |
| Propylene carbonate % wt. | 1.0 | 1.5 |
| Atactic polypropylene % wt. | 5.0 | 5.0 |
| Zinc oxide % wt. | 5.0 | 5.0 |
| Borax % wt. | 4.9 | 5.0 |
| Lubricating base oil % wt. | 76.9 | 73.0 |
| Cone penetration, unworked | 247 | 219 |
| worked | 274 | 283 |
| Open gear rig, 2 hr. run. drop off % wt. | 8.2 | 8.2 |
| coverage | complete | complete |
| 4 ball EP performance, Mean Hertz Load, kg | 55.7 | — |
| Initial Seizure Load kg | 141 | — |
| Welding Load kg | 251 | — |

We claim:

1. A lubricating grease, suitable for use as an open gear lubricant, comprising:

a lubricating base oil;

from 2 to 20%, by weight of total composition of a clay thickener;

from 2 to 12% wt., by weight of total composition of an alkali metal borate as extreme pressure additive; and a combination of an olefin polymer selected from the group consisting of atactic polypropylene and polyisobutylene and a light coloured particulate mineral which is zinc oxide, as tackifier and filler, the polymer and particulate material each being present in an amount of from 3 to 12% wt. by weight of total composition and the polymer; particulate mineral ratio being from 1.5:1 to 1:1.5 by weight.

2. A lubricating grease as claimed in claim 1 wherein the grease also contains from 0.2 to 2% wt. by weight of total composition of an aromatic disulphide as extreme pressure additive.

3. A lubricating grease as claimed in claim 2 wherein the aromatic disulphide is dibenzyl disulphide.

4. A lubricating grease as claimed in claim 2 wherein the ratio of borate to disulphide is from 5:1 to 7:1 by weight.

* * * * *